US007663979B2

(12) United States Patent
Meister et al.

(10) Patent No.: US 7,663,979 B2
(45) Date of Patent: Feb. 16, 2010

(54) TIMEPIECE INCLUDING A DIAL MADE OF SEMICONDUCTOR MATERIAL

(75) Inventors: Pierre-André Meister, Biel (CH); André Zanetta, Neuchâtel (CH); Emmanuel Fleury, Moutier (CH); Fabien Blondeau, Landeron (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 11/470,288

(22) Filed: Sep. 6, 2006

(65) Prior Publication Data

US 2007/0053241 A1 Mar. 8, 2007

(30) Foreign Application Priority Data

Sep. 6, 2005 (EP) ..... 05108136

(51) Int. Cl.
*G04B 19/12* (2006.01)

(52) U.S. Cl. ..... 368/232; 368/155

(58) Field of Classification Search ..... 368/232, 368/155

See application file for complete search history.

(56) References Cited

U.S. PATENT DOCUMENTS

| | | | | |
|---|---|---|---|---|
| 3,427,797 | A * | 2/1969 | Negoro et al. | 368/205 |
| 3,672,155 | A * | 6/1972 | Bergey et al. | 368/159 |
| 3,911,327 | A * | 10/1975 | Murari et al. | 361/718 |
| 4,059,953 | A * | 11/1977 | Morrison et al. | 368/36 |
| 4,165,604 | A * | 8/1979 | Matsumura et al. | 368/288 |
| 4,255,802 | A * | 3/1981 | Ogawa | 368/69 |
| 4,320,483 | A | 3/1982 | Vuilleumier | |
| 4,599,251 | A | 7/1986 | Feller | |
| 6,067,277 | A | 5/2000 | Dinger et al. | |
| 2006/0126443 | A1 * | 6/2006 | Kuo | 368/232 |

FOREIGN PATENT DOCUMENTS

| | | |
|---|---|---|
| CH | 500 532 | 1/1971 |
| CH | 626 496 | 11/1981 |
| DE | 198 57 997 A1 | 9/1999 |
| EP | 0 884 661 A2 | 12/1998 |

(Continued)

OTHER PUBLICATIONS

Binary Code LED Watch :: wristdreams.com/archives/2005/02/binary_code_led.html; Feb. 25, 2005.*

(Continued)

*Primary Examiner*—Vit W Miska
*Assistant Examiner*—Sean Kayes
(74) *Attorney, Agent, or Firm*—Griffin & Szipl, P.C.

(57) ABSTRACT

An electronic timepiece (10) includes a case (12) which is fitted with a dial (28) and which contains an electronic control circuit (22) driving a display device (24), of the type wherein the dial (28) includes a main body (48) in the form of a plate which is made of semiconductor material, and of the type wherein the control circuit (22) includes at least one control unit (36) and a time base circuit (34), characterized in that the control circuit (22) includes at least one integrated circuit element (34, 36) which is etched in the main body (48) of the dial (28).

The invention also proposes a dial (28) to be fitted to the timepiece (10).

20 Claims, 2 Drawing Sheets

FOREIGN PATENT DOCUMENTS

| | | | |
|---|---|---|---|
| FR | 2 855 651 | A1 | 12/2004 |
| JP | 2003066169 | | 3/2003 |
| WO | 01/33711 | A1 | 5/2001 |
| WO | 2004/081695 | A3 | 9/2004 |

OTHER PUBLICATIONS 01 1HEONE :: timetechnology.com; 2005.*
LED watch :: boingboing.net/2004/03/07-week/:: Mar. 13, 2004.*
Integrated Circuit—en.wikipedia.org/wiki/Integrated_circuit :: Aug. 29, 2005.*
Silicon on Insulator (S0I)—web.archive.org/web/20051215000000/en.wikipedia.org/wiki/Silicon_on_insulator :: Dec. 15, 2005.*
Internet Archive—web.archive.org/web/*/http://en.wikipedia.org/wiki/Integrated_circuit :: Nov. 3, 2008.*
15" Plastic Wall Clock :: alibaba.com/product-gs/214604213/15_PLASTIC_WALL_CLOCK.html; no. date.*
Clock :: makintimeclocks.com/clocks/4800.jpg; no date.*
Makin Time Computer Art Clocks :: makintimeclocks.com; no date.*
The Art of Electronics Second Edition: Horowitz and Hill—Cambridge University Press. 1989; pp. 61, 827-835.*
European Search Report issued in corresponding application No. EP 05 10 8136, completed Apr. 21, 2006.
Computer Professional's Dictionary, published by Osborne McGraw-Hill, 1990, pp. 64, 74,191, and 267.
Berner, G.-A., Illustrated Professional Dictionary of Horology I+II, 2002, pp. 13 and 151.
Columbia Encyclopedia entries for "integrated circuit" and "printed circuit," printed from http://www.referencecenter.com/ref/reference/ . . . on Aug. 7, 2009.
http://en.wikipedia.org/wiki/Wikipedia:About, downloaded Feb. 2, 2009, 8 pages, previously filed as "Exhibit A" concurrently with Amendment E.
http://en.wikipedia.org/wiki/Wikipedia:General_disclaimer, downloaded Feb. 2, 2009, 2 pages, previously filed as "Exhibit B" concurrently with Amendment E.

* cited by examiner

TIMEPIECE INCLUDING A DIAL MADE OF SEMICONDUCTOR MATERIAL

CROSS REFERENCE TO RELATED APPLICATIONS

This application claims priority from European Patent Application No. 05108136, filed Sep. 6, 2005, the entire disclosure of which is incorporated herein by reference.

FIELD OF THE INVENTION

The invention concerns a dial made of semiconductor material and an electronic timepiece fitted with the same.

BACKGROUND OF THE INVENTION

Generally, an electronic timepiece such as a wristwatch comprises a case that includes an electronic circuit controlling the display means to display information on a dial. The dial is made in the form of a plate having, on the side of its display face, decorative elements, indices, and/or markings representing for example the numbers of the hours. The dial can also comprise a window associated with a liquid crystal screen connected to the electronic circuit. The dial is usually made of plastic material or metal.

The electronic control circuit is generally arranged on a printed circuit board (PCB) and it includes electronic components such as a control unit, conductive paths, and a reference oscillator which acts as a time base. The oscillator includes a resonator, for example a quartz resonator.

Some watches do not have a PCB. The electronic components are then mounted directly on the back cover of the case. The conductive paths are made, for example, in the form of metallic strips fixed in the case.

The watch structures that have just been described are not completely satisfactory since they require numerous assembly operations, particularly for mounting each of the electronic components either on the PCB, or in the back cover of the case. Moreover, the space requirement of these electronic components in the case is inconvenient when one wishes to make the watch more compact, particularly the thickness thereof.

There also exist watch dials made in a crystalline material such as silicon. Thus, U.S. Pat. No. 4,599,251 discloses and shows a decorative watch article made of silicon. The dial includes a top layer, for example of silicon dioxide, which is light permeable and allows coloured interferences to be formed at its surface. Further, decorative designs or indices can be made on the top surface of the dial, from an opaque material, by printing or vapour phase deposition.

This type of dial has an aesthetic advantage but the general structure of the watch is not altered and still has the same drawbacks.

It is an object of the invention to overcome these drawbacks.

SUMMARY OF THE INVENTION

The present invention therefore proposes an electronic timepiece comprising a case, which is fitted with a dial and which contains an electronic control circuit driving an analogue display device including hands that are driven in rotation by means of a drive device, of the type wherein the dial includes a main body in the form of a plate, which is made of semiconductor material, and of the type wherein the control circuit includes at least one control unit and a time base circuit, characterized in that the control circuit includes at least one integrated circuit element, which is etched into the main body of the dial.

One advantage of the invention is that it facilitates integration of micro or nano-structures in the timepiece. Indeed, micro electromechanical systems, made by etching in a silicon plate, are increasingly used. Owing to the silicon dial and the integrated circuit with which it is provided, it is possible to arrange micro electromechanical systems directly in the dial and to control them, for example, by means of the integrated circuit.

According to other features of the invention:

- the control unit is an integrated circuit element which is directly etched in the main body of the dial;
- the time base circuit is directly etched in the main body of the dial;
- a micro electromechanical system is etched in the main body of the dial and electrically connected to the control circuit;
- the drive device includes an electric motor forming a micro electromechanical system etched in a plate made of semiconductor material and carried by the dial;
- the drive device includes an electric motor forming a micro electromechanical system etched directly in the main body of the dial;
- the main body of the dial is made of silicon;
- since the top face of the main body of the dial forms the display face of the dial, the top face is at least partially coated with a coating;
- since the top face of the main body of the dial forms the display face of the dial, the top face includes raised designs etched in the main body of the dial;
- the timepiece includes a printed circuit board which is arranged under the dial and which carries one part of the control circuit, and the integrated circuit element which is etched in the main body of the dial is electrically connected to conductive paths of the printed circuit board by electric connection means inserted between the bottom face of the dial and the printed circuit board;
- the control circuit assembly is etched in the main body of the dial;

BRIEF DESCRIPTION OF THE DRAWINGS

Other features and advantages of the present invention will appear more clearly upon reading the following detailed description, made with reference to the annexed drawings, given by way of non-limiting example and in which.

DETAILED DESCRIPTION OF THE INVENTION

In the following description, elements that are similar or identical will be designated by the same references.

Figure 1:
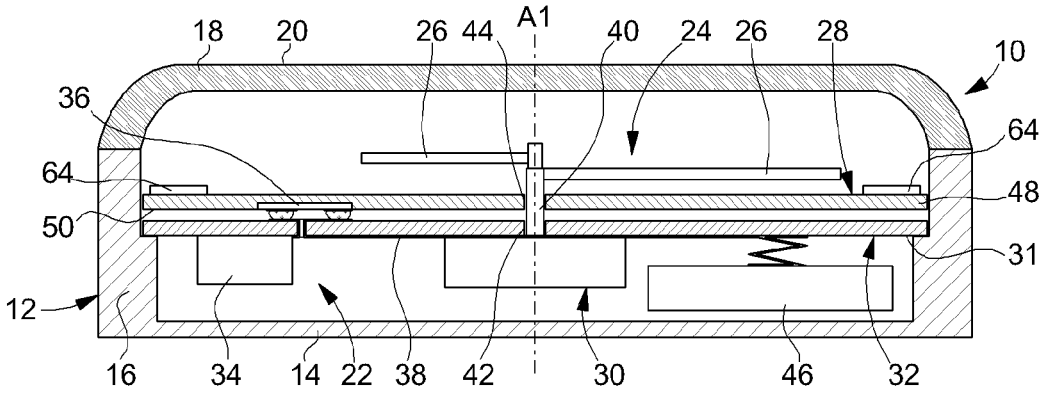
FIG. 1 is an axial cross-section which shows schematically a watch according to a first embodiment in accordance with the teaching of the invention wherein the silicon dial includes an integrated circuit.
Figure 2:
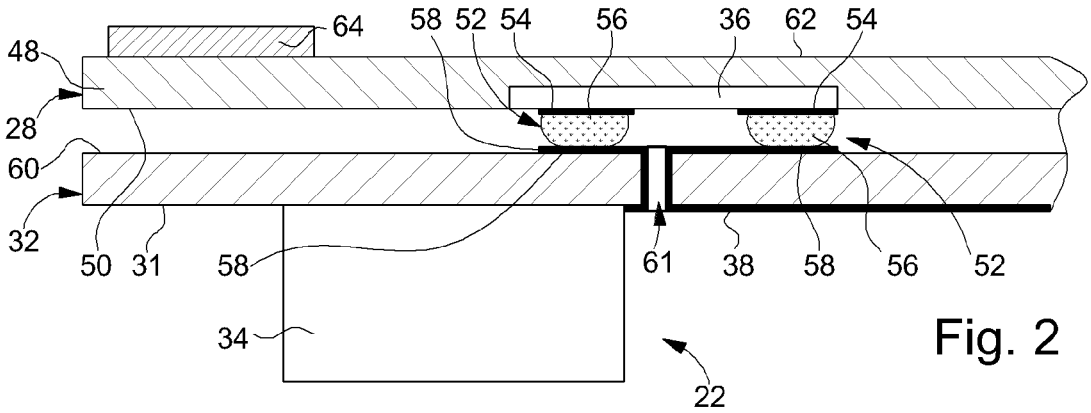
FIG. 2 is a detailed axial cross-section which shows an enlargement of the connection of the integrated circuit of FIG. 1 to the printed circuit board of the watch.

FIGS. 1 to 2 show an electronic timepiece 10 made according to a first embodiment in accordance with the teaching of the invention. Timepiece 10 is formed here by a watch 10 which comprises a case 12, for example of cylindrical shape.

In the following description, a vertical orientation along axis A1 of case 12 will be used in a non-limiting manner.

Case 12 is formed by a bottom wall 14 extending generally in a transverse plane, by a peripheral axial wall 16, and by a top protective crystal 18, which closes case 12 on the side of the top display face 20 of watch 10.

Case 12 includes an electronic control circuit 22 which drives a display device 24.

According to the embodiment shown, display device 24 is of the analogue type. It includes indicator hands 26 which extend above a dial 28 and which are driven in rotation about axis A1 of case 12 by an electrically controlled drive device 30. Drive device 30 includes for example at least one electric watch type motor and transmission means for obtaining the gear reduction required for driving each hand 26.

According to an alternative embodiment (not shown) of the invention, analogue display means 24 can be combined with a liquid crystal display.

Electronic control circuit 22 is arranged in part on the bottom face 31 of a printed circuit board 32 mounted in case 12, under dial 28. Electronic components are arranged on printed circuit board 32, in particular a control unit 36 and a time base circuit formed by a reference oscillator 34. Electrically conductive paths 38 arranged on printed circuit board 32 connect the components to each other.

Control unit 36 can be formed, for example, by a microcontroller or by a logic circuit.

Drive device 30 is mounted here on the bottom face 31 of printed circuit board 32 and its drive arbour 40 extends upwards through a first aperture 42 arranged in printed circuit board 32 and through a second aperture 44 arranged in dial 28.

A battery 46 arranged between printed circuit board 32 and the bottom wall 14 of case 12 provides the electric power supply.

Of course, external control means (not shown) cooperating with control unit 36, such as push buttons or a crown, could be provided to enable the user to control display means 24 and for example set the time.

Dial 28 includes a main body 48, in the form of a circular plate, which is made of semiconductor material. Preferably, this semiconductor material is formed by silicon. Main body 28 can thus be made from a silicon wafer such as those used in microelectronics to make integrated circuits.

In accordance with the teaching of the invention, electronic control circuit 22 includes at least one integrated circuit element 36, which is etched in main body 48 of dial 28, using known methods for fabricating integrated circuits on silicon.

According to the embodiment shown, control unit 36 which is etched in the bottom face 50 of dial 28 forms the integrated circuit element.

As shown in detail in FIG. 2, electronic control circuit 22 is provided with electric connection means 52 which connect the connection studs 54 of control unit 36 to conductive paths 38 of printed circuit board 32. According to the embodiment shown here, these electric connection means 52 are contact bumps 56, for example made from a conductive anisotropic adhesive base, which are arranged on connection studs 54 and which are in electric contact with conductive paths 58 carried by the top face 60 of printed circuit board 32. These conductive paths 58 are electrically connected to the conductive paths 38 carried by bottom face 31 of printed circuit board 32 by means of metallised holes 60 passing right through the board 32.

According to alternative embodiments (not shown), electric connection means 52 can be made differently, for example with metal strips or with a "zebra" type connector comprising an elastomeric strip including parallel conductive wires.

Preferably, dial 28 comprises raised indices 64 on its top face, for example by crystallographic growth. The top face 62 can also include a coating, for example of the metallic type, for protecting and/or decorating dial 28, and can include raised designs in the form of machined micro structures to obtain a similar optical effect to that obtained with guilloche dials. The indices and raised designs can also be obtained by depositing material on dial 28.

Of course, electronic control circuit 22 can include other electronic components such as sensors, a liquid crystal display module, an antenna for watch 10 and/or a radio transmitter/receiver, a coil, data storage units (memories) . . . .

Advantageously, dial 28 can includes several identical control units 36 etched in its bottom face 50. Thus, if one control unit 36 is defective, control circuit 22 can simply be connected to another control unit 36 that is in an operational state.

Dial 28 can also include several control units 36 of different types, which enables the same dial 28 to be used for different types of watches 10. Thus, when watch 10 is being assembled, control circuit 22 can simply be connected to the control unit 36 suited to the type of watch being assembled.

Other embodiments of the invention will now be described mainly considering the differences with respect to the first embodiment.

Figure 3:
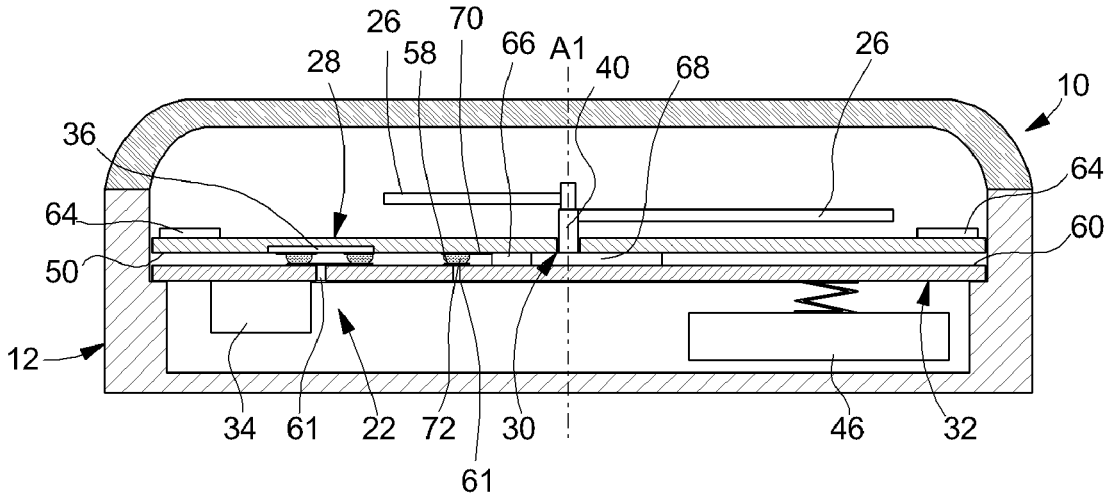
FIG. 3 is a similar view to that of FIG. 1 which shows schematically a watch according to a second embodiment wherein the device driving the hands of the watch includes a motor made of silicon and affixed to the dial.

FIG. 3 shows a second embodiment of watch 10 according to the invention including a drive device 30 wherein the electric motor 66 is made in the form of a micro electromechanical system etched in a silicon plate.

This type of motor 66 is described and shown, for example, in WO Patent No. 2004/081695, incorporated herein by reference. In this Patent, the motor is made by etching in a silicon layer. It includes a toothed drive wheel and actuating fingers which cooperate with the teeth of the wheel to cause it to rotate. Each actuating finger is secured in movement to a mobile comb which moves in relation to a fixed comb as a function of a voltage applied to the fixed comb.

Preferably, an S.O.I (silicon-on-insulator) fabrication technique is used for motor 66, such as that described with reference to FIGS. 7A to 7D in the aforementioned Patent, and which enables the mobile parts to be easily detached from the silicon substrate which carries them.

According to the second embodiment, motor 66 has the form of an added component which is secured to the bottom face 50 of dial 28, for example by bonding or welding. The drive wheel (not shown) for motor 66 meshes with a motion work 68 which is secured adjacently on the bottom face of dial 28 and which drives hands 26 in accordance with a suitable reduction ratio. The bottom face 50 of dial 28 includes conductive paths 70 for connecting motor 66 to associated contact bumps 72 arranged on the bottom face 50 of dial 28. Of course, this electrical connection could be achieved differently, for example by means of conductive wires by the wire bonding technique that is already implemented for integrated circuits.

As for the electric connection of control unit 36 described in relation to FIGS. 1 and 2, the contact bumps 72 associated with motor 66 come into electric contact with conductive paths 58 arranged opposite, on the top face 60 of printed circuit board 32, so as to allow the electrical connection of motor 66 to the other components of control circuit 22. The conductive paths 58 arranged on bottom face 50 of dial 28 can also directly connect motor 66 to control unit 36.

This second embodiment has the advantage of being more compact in height. Moreover, it enables several components to be integrated in dial 28.

Figure 4:
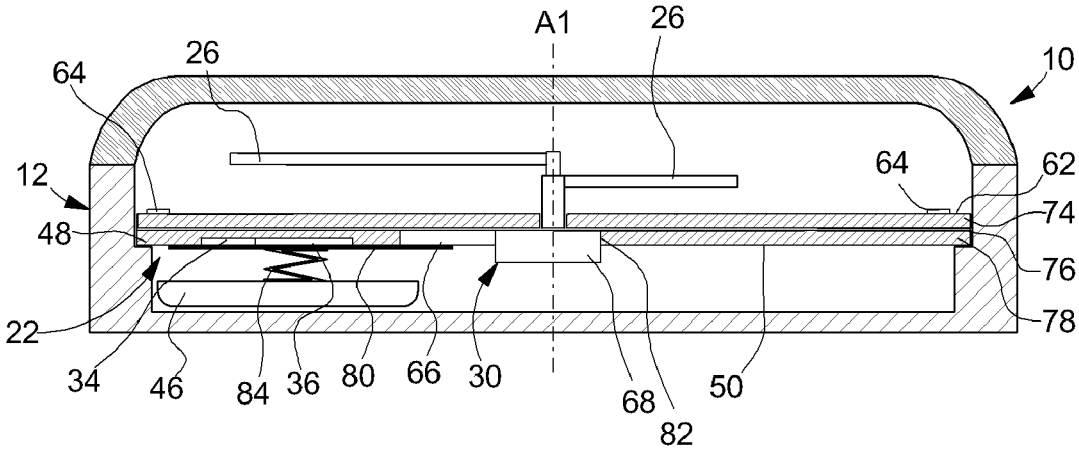
FIG. 4 is a similar view to that of FIG. 1 which shows schematically a watch according to a third embodiment wherein the control circuit component assembly of the watch is formed directly in the silicon dial.

According to a third embodiment, which is shown in FIG. 4, all of the electric components of control circuit 22, and motor 66 of drive device 30, are directly formed by etching in the main body 48 of dial 28. In the example shown, these components are made in the bottom face 50 of dial 28, but they could be made in a similar manner in the top face 62 of dial 28.

The fabrication technique implemented is the S.O.I. technique such that the main body 48 of dial 28 includes, here from top to bottom, a top silicon layer 74 forming a substrate, for example 350 micrometers thick, an intermediate insulating silicon oxide ($SiO_2$) layer, and a bottom silicon layer 78, for example 15 to 75 micrometers thick. The control unit 36, oscillator 34, and motor 66 are formed in the bottom layer 78 to electrically connect the components to each other.

Motor 66 can be made in accordance with the teaching of the aforecited WO Patent No. 2004/081695.

Oscillator 34 can be made in accordance with the teaching of U.S. Pat. No. 6,686,807 B1 that is a U.S. Patent equivalent of WO Patent No. 2001/33711, and U.S. Pat. No. 6,686,807 B1 is incorporated herein by reference, which describes and shows a silicon oscillator provided to be made on the same substrate as the integrated circuit forming control unit 36 of watch 10. Oscillator 34 thus has the form of a micro or nano electromechanical structure, which is etched in main body 48 of dial 28 and which is electrically connected to control circuit 22.

Advantageously, watch 10 has no printed circuit boards here, since all of control circuit 22 is arranged in dial 28.

The motion work 68 is arranged herein a housing 82, which is adjacent to motor 66 and which is arranged in the bottom layer 78 of dial 28, to enable motion work 68 to be driven in rotation by motor 66.

An intermediate electric connection element such as a metal contact strip 84 can be fixed to bottom face 50 of dial 28 to connect battery 46 to control circuit 22.

This embodiment has the advantage of being particularly compact in height. Moreover, it enables the printed circuit board and associated drawbacks to be omitted. Fabrication of control circuit 22 is facilitated since there is no longer a step of assembling/mounting the electronic components, the latter being directly etched in dial 28. The etching techniques used in microelectronics allow batch processing, which minimises fabrication costs.

What is claimed is:

1. An electronic timepiece including:

a case fitted with a dial and that contains an electronic control circuit driving an analogue display device, wherein the analogue display device includes hands driven in rotation by a drive device, wherein the dial is made of semiconductor material, and wherein the electronic control circuit includes at least one control unit and a time base circuit, wherein the control unit includes at least one integrated circuit element etched in the dial.

2. The timepiece according to claim 1, wherein the control unit is an integrated circuit element that is directly etched in the dial.

3. The timepiece according to claim 1, wherein the time base circuit is directly etched in the dial.

4. The timepiece according to claim 1, wherein a micro electromechanical system is etched in the dial and is electrically connected to the control circuit.

5. The timepiece according to claim 1, wherein the drive device includes an electric motor forming a micro electromechanical system etched in a plate of semiconductor material and carried by the dial.

6. The timepiece according to claim 1, wherein the drive device includes an electric motor forming a micro electromechanical system directly etched in the dial.

7. The timepiece according to claim 1, wherein the dial is made of silicon.

8. The timepiece according to claim 1, wherein a top face of the dial forms a display face of the dial, and wherein said top face is at least partially coated with a coating.

9. The timepiece according to claim 8, wherein the coating is a metallic coating.

10. The timepiece according to claim 1, wherein the whole of the control circuit is etched in the dial.

11. An electronic timepiece as recited by claim 1, wherein the dial comprises a main body and the main body includes from top to bottom a first silicon layer, an intermediate insulating layer made of silicon oxide, and a second silicon layer, wherein the at least one control unit and the time base are etched into the second silicon layer.

12. An electronic timepiece including:

a case fitted with a dial that includes a main body, wherein the main body consists of semiconductor material; and an electronic control circuit driving an analogue display device, wherein the analogue display device includes hands driven in rotation by a drive device, wherein the case contains the electronic control circuit, and wherein the electronic control circuit includes at least one control unit and a time base circuit, wherein the control unit includes at least one integrated circuit element etched in the main body of the dial.

13. An electronic timepiece as recited by claim 12, wherein the time base circuit is etched in the main body of the dial.

14. An electronic timepiece as recited by claim 13, wherein the electronic timepiece also includes a micro electromechanical system etched in the main body of the dial, wherein the micro electromechanical system is electrically connected to the control unit and comprises a motor.

15. An electronic timepiece as recited by claim 13, wherein the electronic timepiece also includes a battery disposed between the at least one control unit and a wall of the case, wherein the battery is connected to the at least one control unit and the battery is not etched in the main body of the dial.

16. An electronic timepiece including:

a case fitted with a dial, wherein the whole dial is made of semiconductor material; and an electronic control circuit driving an analogue display device, wherein the analogue display device includes hands driven in rotation by a drive device, wherein the case contains the electronic control circuit, and wherein the electronic control circuit includes at least one control unit and a time base circuit, wherein the control unit includes at least one integrated circuit element etched in the dial.

17. An electronic timepiece including:

a case fitted with a dial, wherein the whole dial is made of semiconductor material; and an electronic control circuit driving an analogue display device, wherein the analogue display device includes hands driven in rotation by a drive device, wherein the case contains the electronic control circuit, and wherein the electronic control circuit includes at least one control unit and a time base circuit, wherein the control unit includes at least one integrated circuit element etched in the dial, and wherein the at least one control unit and the time base circuit are etched in the dial, and the electronic timepiece has no printed circuit boards.

18. An electronic timepiece including:

a case fitted with a dial that includes a main body, wherein the main body consists of semiconductor material; and an electronic control circuit driving an analogue display device, wherein the analogue display device includes hands driven in rotation by a drive device, wherein the case contains the electronic control circuit, and wherein the electronic control circuit includes at least one control unit and a time base circuit, wherein the control unit includes at least one integrated circuit element etched in the main body of the dial and wherein the time base circuit is etched in the main body of the dial, wherein the electronic timepiece also includes a micro electromechanical system etched in the main body of the dial, wherein the micro electromechanical system is electrically connected to the control unit and comprises a motor, and wherein the semiconductor material is silicon and the electronic timepiece has no printed circuit boards.

19. An electronic timepiece including:

a case fitted with a dial and that contains an electronic control circuit driving an analogue display device, wherein the analogue display device includes hands driven in rotation by a drive device, wherein the dial is made of semiconductor material, and wherein the electronic control circuit includes at least one control unit and a time base circuit, wherein the control unit includes at least one integrated circuit element etched in the dial, and wherein a top face of the dial forms a display face of the dial, and wherein said top face includes raised designs etched in the dial.

20. An electronic timepiece including:

(a) a case fitted with a dial and that contains an electronic control circuit driving an analogue display device, wherein the analogue display device includes hands driven in rotation by a drive device, wherein the dial is made of semiconductor material, and wherein the electronic control circuit includes at least one control unit and a time base circuit, wherein the control unit includes at least one integrated circuit element etched in the dial; and (b) a printed circuit board arranged under the dial and that carries one part of the control circuit, and wherein the integrated circuit element that is etched in the dial is electrically connected to conductive paths of the printed circuit board by electric connection means inserted between a bottom face of the dial and the printed circuit board.

* * * * *